US008113347B2

(12) United States Patent
Kohring et al.

(10) Patent No.: US 8,113,347 B2
(45) **Date of Patent: *Feb. 14, 2012**

(54) RAZOR STORAGE CASE HAVING MATING CLOSURE MEMBERS

(75) Inventors: Douglas Robert Kohring, Chelmsford, MA (US); Kelly Daniel Bridges, Quincy, MA (US)

(73) Assignee: Gillette Company, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/897,281

(22) Filed: Aug. 30, 2007

(65) Prior Publication Data

US 2009/0057170 A1 Mar. 5, 2009

(51) Int. Cl.
*B65D 83/10* (2006.01)
*A45C 11/26* (2006.01)

(52) U.S. Cl. ..... 206/352; 206/356

(58) Field of Classification Search ..... 206/352–360, 206/1.5, 208, 228, 15.2, 15.3, 361; 30/541
See application file for complete search history.

(56) References Cited

U.S. PATENT DOCUMENTS

| | | | | |
|---|---|---|---|---|
| 1,189,118 | A * | 6/1916 | Jonas | 206/208 |
| 2,792,108 | A * | 5/1957 | Keller | 206/208 |
| 2,928,531 | A * | 3/1960 | Henley | 206/357 |
| 5,645,164 | A * | 7/1997 | Hocking | 206/15.3 |
| 5,771,592 | A | 6/1998 | Nizker | |
| 5,924,567 | A * | 7/1999 | Wenum | 206/15.3 |
| 5,966,902 | A * | 10/1999 | Korycki | 206/209 |
| 6,145,645 | A | 11/2000 | Cox | |
| 6,145,657 | A * | 11/2000 | Cox | 206/208 |
| 6,196,410 | B1 * | 3/2001 | Hocking | 206/362 |
| 6,530,470 | B2 * | 3/2003 | Roundy | 206/15.3 |
| 6,634,492 | B1 * | 10/2003 | Cox | 206/228 |
| 7,434,684 | B1 * | 10/2008 | Mabra | 206/315.11 |
| 2002/0117411 | A1 | 8/2002 | Ortiz | |
| 2003/0209457 | A1 * | 11/2003 | Coffin et al. | 206/352 |
| 2006/0242848 | A1 | 11/2006 | Ciccone | |
| 2007/0062044 | A1 | 3/2007 | Walker et al. | |

FOREIGN PATENT DOCUMENTS

| | | | |
|---|---|---|---|
| EP | 854 020 | A1 | 7/1998 |
| WO | WO 96/18480 | A1 | 6/1996 |
| WO | WO 2007/049031 | A1 | 5/2007 |

* cited by examiner

*Primary Examiner* — Luan K Bui
(74) *Attorney, Agent, or Firm* — Austin P. Wang; Kevin C. Johnson; Steven W. Miller

(57) ABSTRACT

A wet shaving razor case suitable for storage of a razor having a cartridge and adjoining handle, the case comprises an upper portion comprising a cartridge hold down member disposed at a periphery of said upper portion and a handle-receiving recess; a lower portion joined to the upper portion wherein the lower portion comprises a engagement member positioned along a periphery of the lower portion; and wherein upon closure of the upper portion onto the lower portion the hold down member both secures the cartridge within the case and engages with the engagement member to maintain closure of the upper portion on the lower portion.

13 Claims, 5 Drawing Sheets

RAZOR STORAGE CASE HAVING MATING CLOSURE MEMBERS

FIELD OF THE INVENTION

This invention relates to a wet shaving razor case that is suitable for storage of a razor having a cartridge and adjoining handle.

BACKGROUND OF THE INVENTION

Over the years, consumers have become more mobile in their daily lives. This becomes even more apparent as the goods that are commonly used by consumers are tailored for improved mobility and easy travel by manufacturers that recognize this behavior change. One consumer area that has followed this trend is wet shaving razors in that a number of razors are intended for a relatively limited number of uses (referred to as "disposable") while others are in the form of systems that comprise a longer term use handle that is joined to a removably disposable cartridge. With respect to both types of razor products, it is becoming more commonplace for such razors to incorporate some mechanism of shaving aid application to reduce frictional drag of the razor across the skin, soften hair, or condition skin. Typical shaving aid mechanisms incorporated within a razor include lubrication strips, indicator strips, soap wings, shave gel bars, and similar shaving aid as disclosed in U.S. Pat. Nos. 5,956,848, 5,998,431, 5,906,834, 6,185,822, 6,298,559, 6,301,785, 6,442,839, 6,944,952, 7,069,658; and US Patent Publications US 2006/0143925 A1, 2006/0080838 A1, and 2007/0110703 A1. As manufacturers strive to present consumers with more of these mechanisms, which tend to be water soluble to a certain extent, it is clear that there is a need for a razor case that is suitable for storage of such razors when they are used at home or away from home, e.g., while traveling or even at a gym. In particular, there is a need for a razor storage case that is suitable for 1) storing the razor in a manner that protects a consumer from unintended contact with the cutting edges of the blades during transport, 2) protecting the cutting edges of the blades from dulling by contact with unintended contact during such transport and/or storage, and 3) preserving the remaining shaving aid on the razor cartridge when not in use.

SUMMARY OF THE INVENTION

In accordance with the present invention, the wet shaving razor case suitable for storage of a razor wherein the razor includes a cartridge and adjoining handle and wherein the case comprises an upper portion comprising a cartridge hold down member disposed at a periphery of the upper portion and a handle-receiving recess; a lower portion joined to the upper portion wherein the lower portion comprises a engagement member positioned along a periphery of the lower portion; and wherein upon closure of the upper portion onto the lower portion the hold down member both secures the cartridge within the case and engages with the engagement member to maintain closure of the upper portion on the lower portion.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
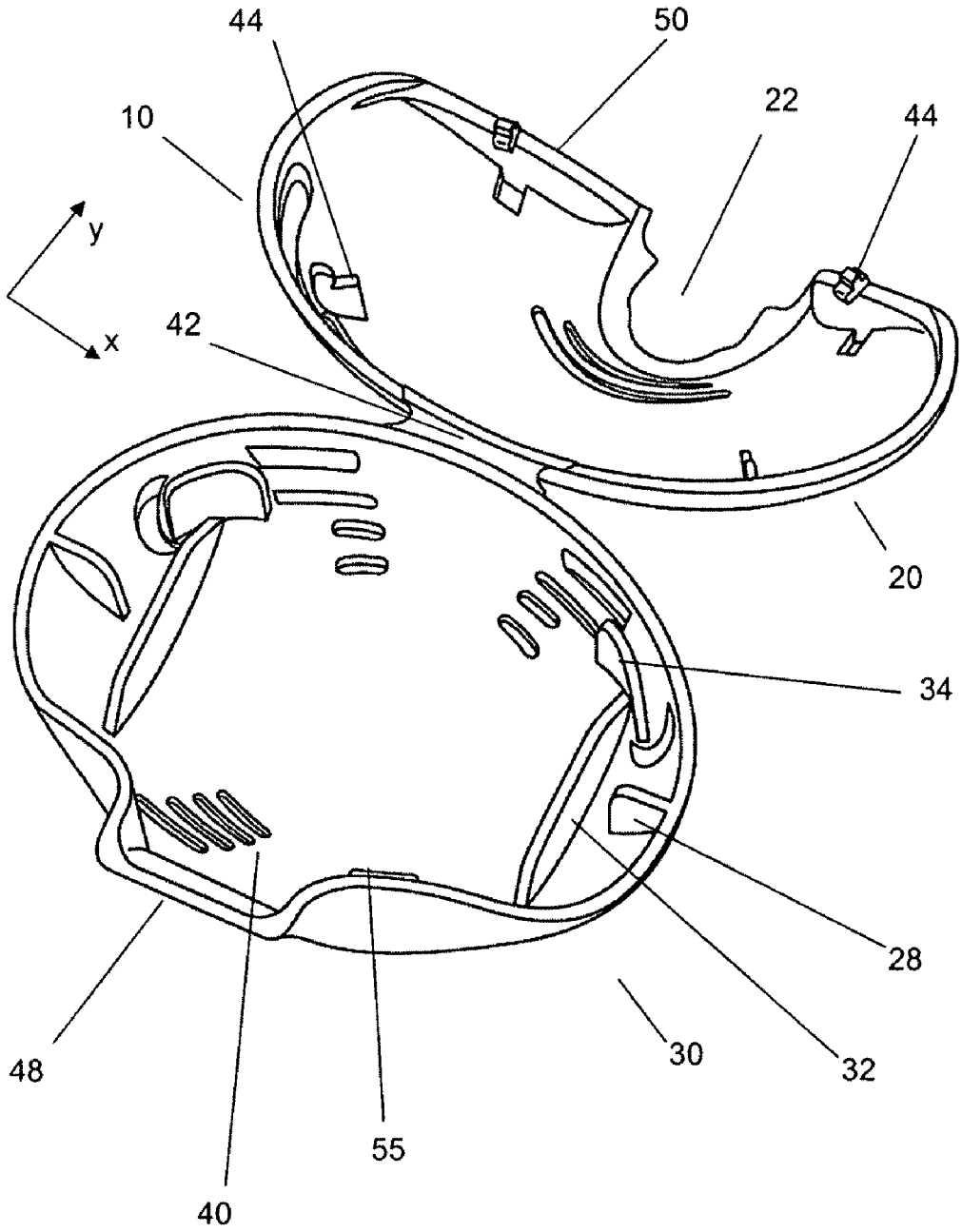
FIG. 1 is a top isometric view of a storage case of the present invention in an opened position.
Figure 2:
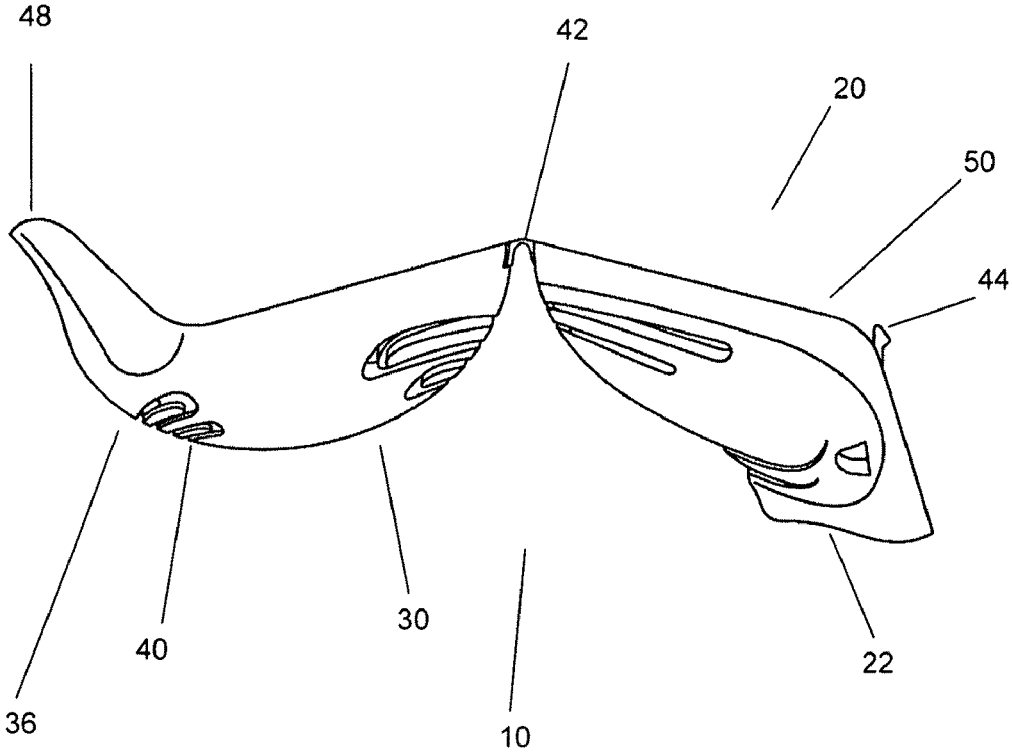
FIG. 2 is a right side elevational view of the opened position storage case of FIG. 1.
Figure 3:
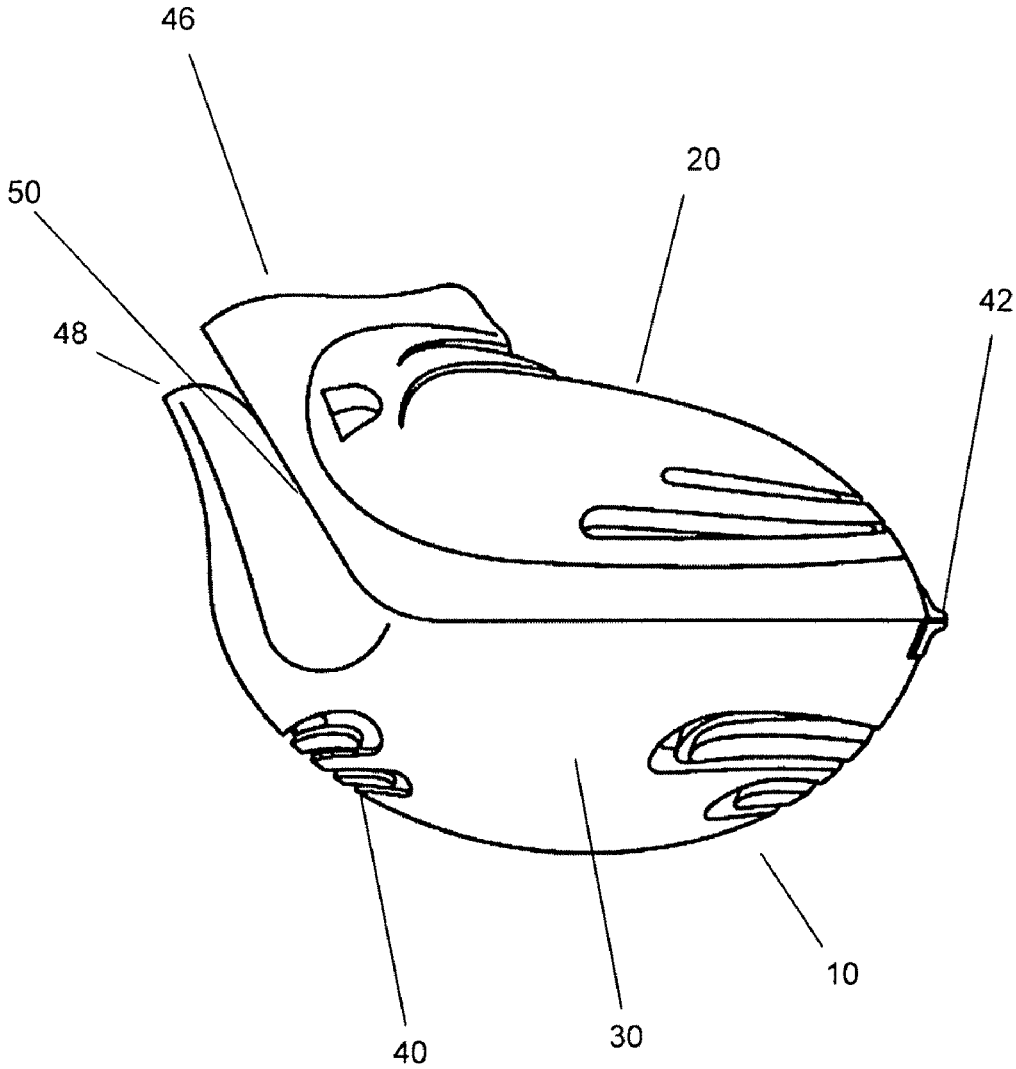
FIG. 3 is right side elevational view of a storage case of the present invention in a closed position.

Referring to FIGS. 1-3, there is shown a wet shaving razor case 10 suitable for storage of a razor having a cartridge and an adjoining handle. The case comprises an upper portion 20 and a lower portion 30 joined to the upper portion. The upper portion 20 comprises a handle-receiving recess 22. The lower portion 30 comprises a engagement member 32 that is disposed along a periphery of the lower portion 30. The embodiment of FIG. 1 further illustrates the inclusion of a lower spacing member 32 that may be situated between a front end and a rear end of the case 10. The lower spacing member 32 provides clearance between a razor cartridge and an interior surface of the lower portion 30 of the case 10. This clearance allows for potential drying of any shaving aid that is integrated within the cartridge and is also useful in preventing unnecessary wear of a cutting edge of a shaving blade that is likely included in the razor cartridge. Additionally, in FIG. 1, an x-direction is shown which is transverse to a y-direction. The x-direction represents the lateral (widthwise) span of the case, while the y-direction represents a front to rear span of the case. There is a cartridge centering guide 28 that is disposed on the lower portion. In the embodiment of FIG. 1, there is shown an additional centering guide on an opposing side to provide increased stability of a cartridge.

The front end of the case is indicated by the presence of the forward stabilization guide 34 and the rear of the case merely opposes the front end. In FIG. 1, the lower spacing member 32, the forward stabilization guide 34 and the cartridge centering guide 28 may cooperate to minimize movement of a razor cartridge in the x-direction when the upper portion 20 and the lower portion 30 are closed upon one another. In an embodiment that is not shown, the forward stabilization guide 34 may further comprise a retaining lip. This lip m act to engage and retain a leading edge of a cartridge that is being inserted into the case 10. As there may be one or more forward stabilization guides 34 at the front end of the case, there may be retaining lip(s) on one or more of the forward stabilization guides 34.

In FIGS. 1-3, optional vent(s) 40 disposed in the upper portion 20 and the lower portion 30 is shown. One or more vents 40 may be particularly useful for inclusion into the case of the present invention to aid in evaporation and/or drainage of water or additional fluids used during a shaving experience. The ability of the case to "breathe" may also extend the life of any shaving aid that is integrated with a stored razor cartridge. It is likely that the usefulness of the cartridge will be extended due to an absence of undue pressure on the razor cartridge's shaving aid when not in use. It is believed that the lower spacing member 32 prevents contact between a front leading surface of a razor (which typically includes a large portion of a shaving aid's skin contacting surface). The optional vent 40 may act in cooperation with the lower spacing member 32 in facilitating airflow through the case when in a closed position. One or more vents 40 may be present in various positions on the lower and/or upper portion 20, 30 of the case 10.

Furthermore, it is also envisioned that the lower spacing member 32 of FIG. 1 may be multiplied so that there is a plurality of lower spacing members 32 along the x-direction of the case to provide even more support to a cartridge that is placed in the case. For instance, where there is an additional lower spacing member 32 disposed along the x-direction, the first lower spacing member 32 may be disposed toward right side of the case while the additional member 32 is disposed toward the left side of the case. Alternatively, the lower spacing member 32 may have an increased width from that shown in FIG. 1 such that the width of a single lower spacing member 32 spans greater than about 5%, 15%, 25%, 40%, 50%, 60%, 75%, or even greater than about 80% of the width of the case. The lower spacing member 32 also has a length that spans the y-direction. The length of the lower spacing member 32 may vary corresponding to the spans detailed above relative to the width. There may also be additional lower spacing members 32 disposed in the y-direction to provide improved clearance of a cartridge within the case. That is, a plurality of lower spacing members 32 may be spaced serially (from end to end) along the y-direction. Conversely, this same configuration may be used in the x-direction of the case.

The upper portion 20 of the case 10 is joined to the lower portion 30 in the present invention. In the embodiments shown in FIGS. 1-3, the joinder between the two portions results from the presence of a hinge 42. This hinge 42 may present itself in the form of a living hinge, a multi-component cooperating hinge (e.g., with parts from the upper portion interlocking with parts from the lower portion). There may also be a pinning member present that slides through the interlocking parts of the lower and upper portions and that acts to maintain contact between the respective parts and serves as a center of axis for the hinged joint.

Figure 4:
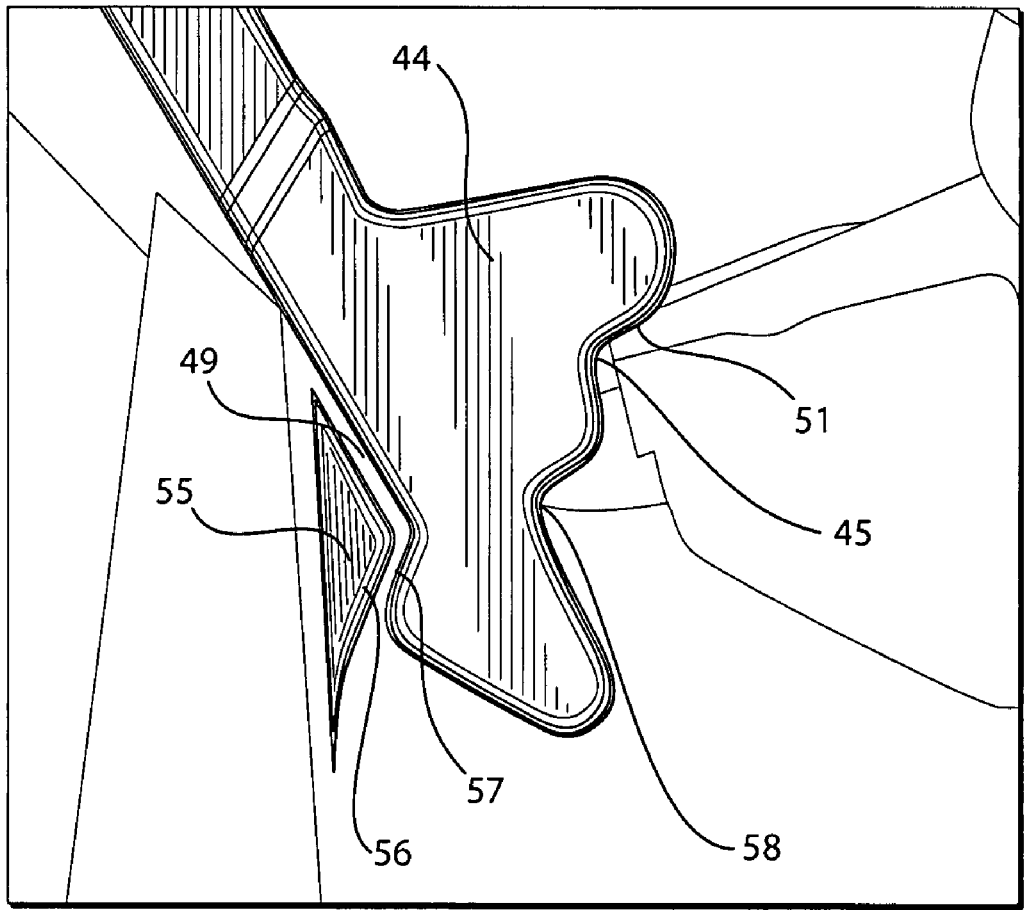
FIG. 4 is a expanded view of a cartridge hold down member cooperating with an engagement member as described in the present invention.

Applicant has found that the present invention addresses the need of not only securing a razor cartridge within a storage case but additionally securely closing the case with a combined securing/closing system. This system involves cooperation between a cartridge hold down member 44 that is disposed at a periphery of the upper portion and a engagement member 55 that is positioned along a mating periphery of the lower portion 30. The engagement member 55 has an active restraining surface 56 that engages with a rear notch 49 that comprises a snap surface 57. The cooperation occurs as a razor cartridge is inserted into the lower portion 30. A user then closes the upper portion 20 down upon the lower portion 30 thereby pushing the cartridge hold down member 44 down over an edge (may be a front or rear edge depending on placement of the cartridge hold down member within the interior of the case) of the razor cartridge and locking the cartridge hold down member 44 down upon the cartridge by engagedly slipping over a front notch 45 of the cartridge hold down member 44. A hold down surface 51 comprised within the front notch 45 serves to apply downward pressure to the cartridge. As consistent downward pressure is applied by the user down upon the upper portion 20 or upward pressure from below onto the lower portion 30 to effect closure of the case, the engagement member 55 is forced to engagedly slip into a rear notch 49 on the rear of the cartridge hold down member 44. In the embodiment shown in FIG. 4, the cartridge hold down member 44 additionally comprises a secondary front notch 58 that is disposed below the first front notch 45 on the cartridge hold down member 44. This optional secondary front notch 58 may serve as a clearance point for the cartridge to ensure that the cartridge is engaging with the upper portion 20 while the first front notch 45 then retains the engagement. In certain embodiments, there may be a plurality of cartridge hold down members 44 on the lower portion 30 or on the upper portion 20 to improve securing of the closure between the two portions. It may be preferred for the upper portion 20 to comprise a plurality of cartridge hold down members 44 to heighten the security of the razor cartridge within the case upon closure. For instance, there may be a pair of cartridge hold down members 44 at the front end of the case or at the rear end of the case or both.

Additionally, the case comprises a handle-receiving recess 22 in the upper portion 20. This recess 22 provides an area of clearance for a razor handle that protrudes from the case while a razor cartridge portion of a razor is being stored in the case. When the upper portion 20 is closed upon the lower portion 30, an enclosure 46 is formed by the handle-receiving recess 22 and a handle rest 48, which is disposed toward the rear of the lower portion 30.

The upper portion may comprise an opening tab 50 to facilitate a user in releasing the upper portion from the lower portion in preparation for shaving. The opening tab 50 may be disposed adjacent the handle-receiving recess 22 and may be present on both sides of such recess 22.

Figure 5:
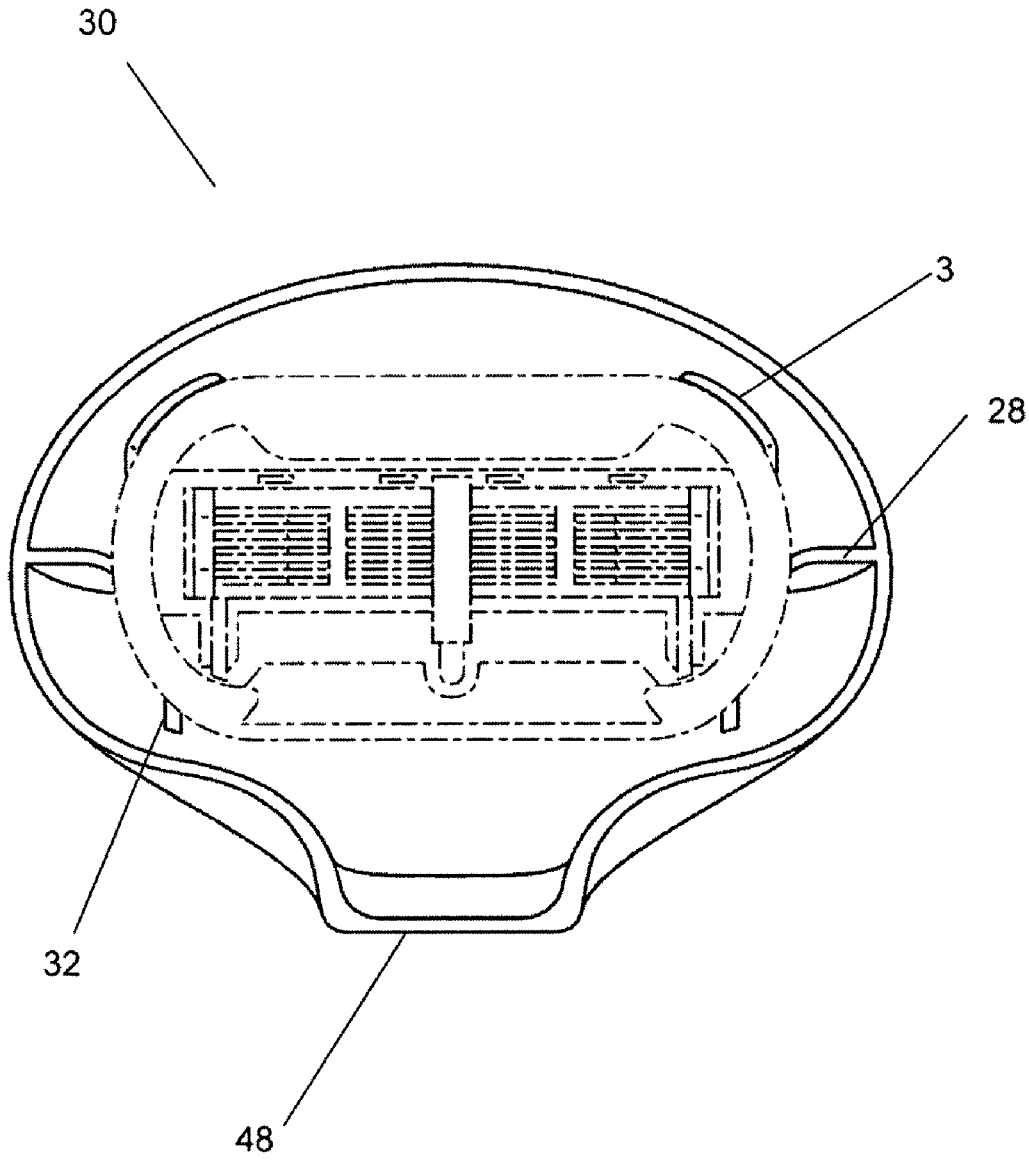
FIG. 5 a top plan view of the lower portion of the case of FIG. 1.

FIG. 5 shows a top plan view of the lower portion with a razor cartridge placed in it. The placement of the razor cartridge makes it clear how the components within the lower portion work together to stabilize the cartridge.

In the embodiment of FIGS. 1-3 and 5, the interior components of the upper and lower portions are integrally molded with the portions. Specifically, as shown in FIG. 1, each of the cartridge hold down member, the cartridge centering guide, the lower spacing member, the front stabilization guide, and the engagement member are integrally molded into their respective upper and lower portions. In another embodiment, it is required that at least one component selected from the group consisting of the cartridge hold down member, the cartridge centering guide, the lower spacing member, the front stabilization guide, and combinations thereof are integrally molded with the lower portion or even the upper portion (where appropriate).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for storing a wet shaving razor comprising:
a razor having a cartridge and an adjoining handle; and
a case for storing said razor, said case comprising:

a. an upper portion comprising a first cartridge hold down member disposed at an interior periphery of said upper portion and a second cartridge hold down member disposed about a handle-receiving recess within an interior of said upper portion, wherein said first cartridge hold down member comprises a concave securing surface facing an interior of said upper portion;

b. a lower portion joined to said upper portion wherein said lower portion comprises an engagement member positioned along an interior periphery of said lower portion; and wherein upon closure of said upper portion onto said lower portion said concave securing surface contacts and secures said cartridge within said case and said second cartridge hold down member engages with said engagement member to maintain closure of said upper portion on said lower portion.

2. The system of claim 1 wherein said lower portion further comprises a lower spacing member.

3. The system of claim 2 wherein said lower portion further comprises a forward stabilization guide.

4. The system of claim 3 wherein said lower portion further comprises a cartridge centering guide to minimize movement of said cartridge in the x-direction when said upper and lower portions are closed upon one another.

5. The system of claim 1 wherein said lower and/or upper portion comprises at least one vent.

6. The system of claim 1 wherein said upper portion is joined to said lower portion via a hinge.

7. The system of claim 1 wherein said handle-receiving recess forms an enclosure for said handle when said upper and lower portions closed upon one another.

8. The system of claim 2 wherein said lower spacing member is elongate and has a length that runs in the y-direction.

9. The system of claim 8 wherein said case further comprises at least one additional lower spacing member that is elongate and disposed in the y-direction.

10. The system of claim 2 wherein said lower spacing member is elongate and has a length that runs in the x-direction.

11. The system of claim 10 wherein said case further comprises at least an additional lower spacing member that is elongate and disposed in the x-direction.

12. The system of claim 1 wherein said upper portion comprises a plurality of cartridge hold down members.

13. The system of claim 4 wherein at least one of said cartridge hold down member, said cartridge centering guide, said lower spacing member, said engagement member, and said forward stabilization guide are integrally molded with the portions.

* * * * *